US008973800B2

(12) United States Patent
Liu et al.

(10) Patent No.: US 8,973,800 B2
(45) Date of Patent: Mar. 10, 2015

(54) AMPOULE OPENER

(71) Applicants: Fu-Chao Liu, Taoyuan County (TW); San-I Huang, Taichung (TW); Po-Yao Huang, Taichung (TW); Hung-Ni Huang, Taichung (TW)

(72) Inventors: Fu-Chao Liu, Taoyuan County (TW); San-I Huang, Taichung (TW); Po-Yao Huang, Taichung (TW); Hung-Ni Huang, Taichung (TW)

(73) Assignee: San-I Huang, Taichung (TW)

( * ) Notice: Subject to any disclaimer, the term of this patent is extended or adjusted under 35 U.S.C. 154(b) by 149 days.

(21) Appl. No.: 13/799,833

(22) Filed: Mar. 13, 2013

(65) Prior Publication Data

US 2014/0263531 A1 Sep. 18, 2014

(51) Int. Cl.
*B67B 7/92* (2006.01)
*B67B 7/44* (2006.01)

(52) U.S. Cl.
CPC .... *B67B 7/92* (2013.01); *B67B 7/44* (2013.01)
USPC ..... 225/93; 225/103; 83/195; 83/198

(58) Field of Classification Search
CPC ..... B67B 7/92; B26F 3/00; B26F 3/002
USPC ..... 225/93, 94, 103, 96, 96.5; 83/196, 198; 241/99; 604/181, 182, 200, 87; 222/83.5, 87, 88, 541.1–541.4, 541.6; 30/109, 111, 113, 90.1
See application file for complete search history.

(56) References Cited

U.S. PATENT DOCUMENTS

| | | | | |
|---|---|---|---|---|
| 2,503,517 | A * | 4/1950 | Sirica | 30/94 |
| 2,508,696 | A * | 5/1950 | Thompson | 451/540 |
| 2,515,020 | A * | 7/1950 | Scott | 30/164.9 |
| 3,450,319 | A * | 6/1969 | Campbell, Jr. et al. | 225/104 |
| 4,508,250 | A * | 4/1985 | Punchak | 225/97 |
| 4,570,838 | A * | 2/1986 | Szemere et al. | 225/93 |
| 5,398,413 | A * | 3/1995 | Chen | 30/90.1 |
| 6,089,125 | A * | 7/2000 | Cheng | 81/9.44 |
| 6,099,510 | A * | 8/2000 | Ruther et al. | 604/181 |
| 6,439,084 | B1 * | 8/2002 | Ebert | 81/9.41 |
| 7,137,204 | B2 * | 11/2006 | Wiste | 30/90.1 |
| 8,448,830 | B2 * | 5/2013 | Starr | 225/96.5 |
| 8,840,001 | B2 * | 9/2014 | Pluska | 225/93 |

* cited by examiner

*Primary Examiner* — Phong Nguyen
(74) *Attorney, Agent, or Firm* — Hershkovitz & Associates, PLLC; Abe Hershkovitz

(57) ABSTRACT

An ampoule opener has an opening unit and a cover unit. The opening unit is a rigid frame and has two panels, two head-clamping holes and two pairs of wave-shaped flanges. The panels are respectively an upper panel and a lower panel. The head-clamping holes are elongated in length and tapered in width and are respectively formed through the panels. The pairs of wave-shaped flanges are formed between the panels and the head-clamping holes. The cover unit is flexible, is detachably mounted around the opening unit and has two covering boards, a mounting recess, two body-clamping holes and two pairs of wave-shaped edges. The body-clamping holes are elongated in length and tapered in width and are respectively formed through the mounting boards and communicate with the mounting recess. The pairs of wave-shaped edges are formed between the mounting boards and the body-clamping holes.

10 Claims, 7 Drawing Sheets

AMPOULE OPENER

BACKGROUND OF THE INVENTION

1. Field of the Invention

The present invention relates to an ampoule opener, and more particularly to an ampoule opener that can be used to open an ampoule safely and conveniently.

2. Description of Related Art

A conventional ampoule is made of glass and is used to store injectable medications or chemical pharmaceuticals for isolation from air contact. The conventional ampoule has a body, a neck formed on the body, and a head formed on the neck. In use, the neck of the conventional ampoule has to be pre-scored and sterilized. The user can break the neck to separate the head from the body of the conventional ampoule to withdraw the injectable medications or the chemical pharmaceuticals that are stored in the body of the conventional ampoule. As a preferred practice of the industry, the conventional ampoules are pre-scored on the neck by the manufacturer. Then, the user can snap off the neck along the scoring to separate the head from the body of the conventional ampoule.

The conventional ampoule is usually used to store the injectable medications and the medical staff needs to break the neck of the conventional ampoule to withdraw the medication before injection in performed. However, the broken neck of the conventional ampoule may injure the medical staff and even further cause infection. As such, the conventional ampoule is unsafe and inconvenient in use.

To overcome the shortcomings, the present invention provides an ampoule opener to mitigate or obviate the aforementioned problems.

SUMMARY OF THE INVENTION

The primary objective of the present invention is to provide an ampoule opener that can be used to open an ampoule safely and conveniently.

The ampoule opener in accordance with the present invention has an opening unit and a cover unit. The opening unit is a rigid frame and has two panels, two head-clamping holes and two pairs of wave-shaped flanges. The panels are respectively an upper panel and a lower panel. The head-clamping holes are elongated in length and tapered in width and are respectively formed through the panels. The pairs of wave-shaped flanges are formed between the panels and the head-clamping holes. The cover unit is flexible, is detachably mounted around the opening unit and has two covering boards, a mounting recess, two body-clamping holes and two pairs of wave-shaped edges. The body-clamping holes are elongated in length and tapered in width and are respectively formed through the mounting boards and communicate with the mounting recess. The pairs of wave-shaped edges are formed between the mounting boards and the body-clamping holes.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
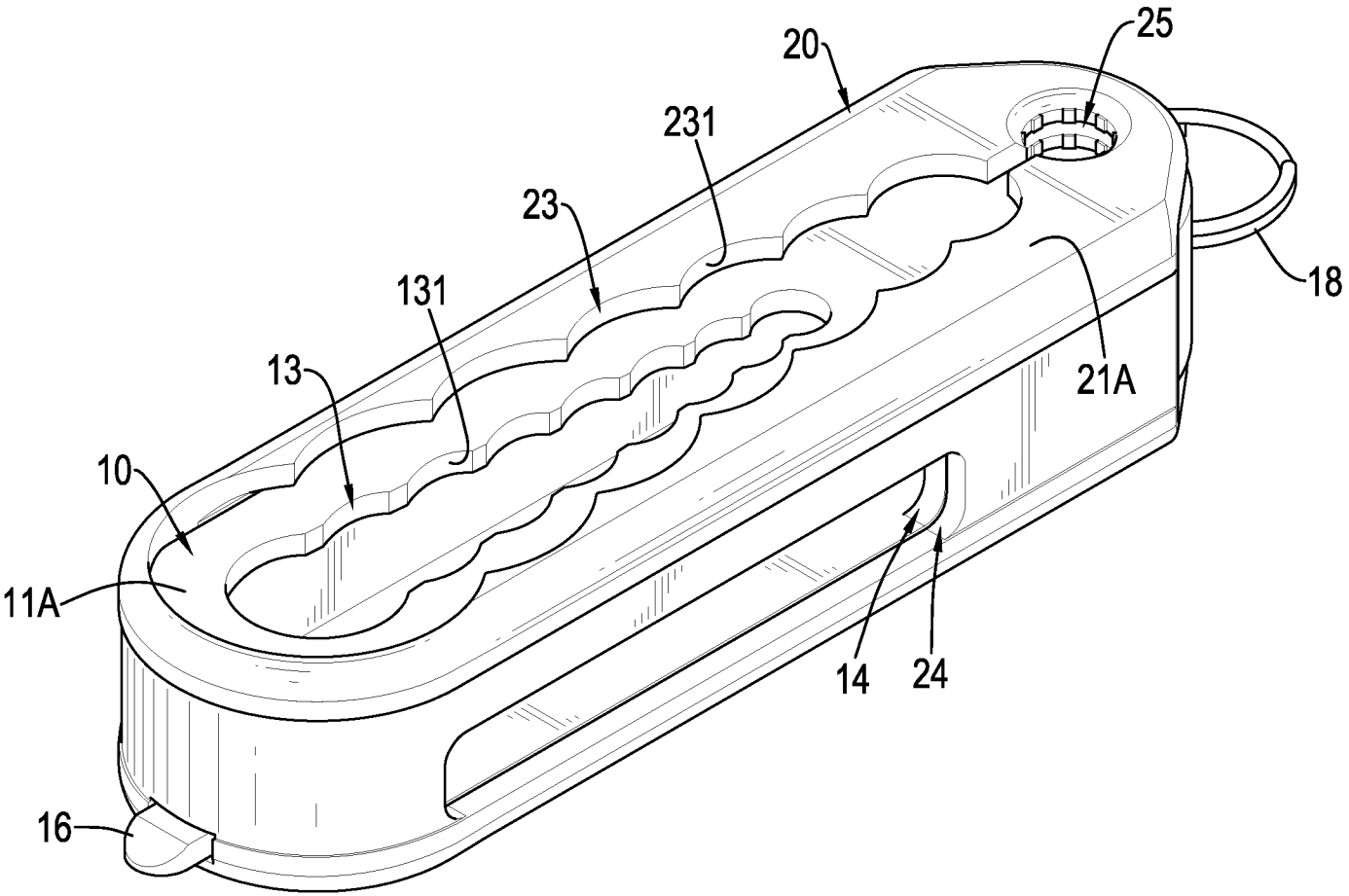
FIG. 1 is a perspective view of an ampoule opener in accordance with the present invention.

With reference to FIGS. 1 to 4, an ampoule opener for an ampoule 50 in accordance with the present invention has an opening unit 10 and a cover unit 20. The ampoule 50 has a body 51, a neck 52, a head 53, and a scoring mark 54.

The opening unit 10 is a rectangular rigid frame and has two sidewalls, a closed rear side, an open front side, two panels 11A, 11B, a chamber 12, two head-clamping holes 13, a view window 14, two inserting holes 15, a driving tab 16, two positioning blocks 17 and a hanging ring 18. The sidewalls of the opening unit 10 are formed with the closed rear side of the opening unit 10.

The panels 11A, 11B are respectively an upper panel 11A and a lower panel 11B, are formed with the sidewalls and the closed side of the opening unit 10, and face each other. Each panel 11A, 11B has a length, a mounting end and a holding end. The chamber 12 is formed in the opening unit 10 between the sidewalls, the closed rear side, and the panels 11A, 11B of the opening unit 10 and communicates with the open front side of the opening unit 10.

The head-clamping holes 13 are elongated, are respectively formed through the panels 11A, 11B proximal to the mounting ends of the panels 11A, 11B and communicate with the chamber 12, and each head-clamping hole 13 has a length and a width. Furthermore, each head-clamping hole 13 is tapered from the mounting end to the holding end of a corresponding panel 11A, 11B. In addition, a ratio of the length of the head-clamping hole 13 to the length of the panel 11A, 11B is two-thirds. Furthermore, the opening unit 10 has two pairs of wave-shaped flanges 131 formed between the panels 11A, 11B and the head-clamping holes 13 to enable the head-clamping holes 13 to clamp the heads 53 of the ampoules 50 of various sizes.

The view window 14 is formed through one of the sidewalls of the opening unit 10 between the panels 11A, 11B and communicates with the chamber 12. The inserting holes 15 are respectively formed through the panels 11A, 11B proximal to the holding ends of the panels 11A, 11B, align with each other, and communicate with the chamber 12. The opening unit 10 further has multiple engaging protrusions 151 formed in the inserting holes 15 at intervals to engage a needle cap. In addition, the inserting hole 15 that is formed through the upper panel 11A has a diameter larger than a diameter of the inserting hole 15 that is formed through the lower panel 11B, such that the needle cap is inserted and positioned in a unidirectional manner.

Preferably, the opening unit 10 has a slot 111, an elastic arm 112, and an engaging element 113. The slot 111 is C-shaped and is formed through the lower panel 11B and between the head-clamping hole 13 and the inserting hole 15 of the lower panel 11B. The elastic arm 112 is formed on and protrudes from the lower panel 11B between the slot 111 and the head-clamping hole 13 of the lower panel 11B and has a free end proximal to the inserting hole 15 of the lower panel 11B. The engaging element 113 is formed on and protrudes from the free end of the elastic arm 112.

The driving tab 16 is formed on and protrudes from the mounting end of the lower panel 11B. The positioning blocks 17 are formed on and protrude from a bottom face of the lower panel 11B, are each respectively formed proximal to the driving tab 16 and proximal to the inserting hole 15, and align with each other. The hanging ring 18 is mounted on the closed rear side of the opening unit 10 between the holding ends of the panels 11A, 11B.

The cover unit 20 is made of a flexible material such as rubber or silicone, is detachably mounted around the opening unit 10 and has an open rear side, a closed front side, two sidewalls, two covering boards 21A, 21B, a mounting recess 22, two body-clamping holes 23, a view window 24, two via holes 25, a through hole 26 and a positioning groove 27. The closed front side of the cover unit 20 is formed with the sidewalls of the cover unit 20.

The covering boards 21A, 21B are respectively an upper covering board 21A and a lower covering board 21B, and are formed with the sidewalls and the closed front side of the cover unit 20. The mounting recess 22 is formed in the cover unit 20 between the sidewalls, the closed front side and the covering boards 21A, 21B of the cover unit 20 and communicates with the open rear side of the cover unit 20. Then, the opening unit 10 can be mounted in the mounting recess 22 of the cover unit 20 via the open rear side of the cover unit 20.

The body-clamping holes 23 correspond to the head-clamping holes 13 of the opening unit 10, are elongated and are each respectively formed through the mounting boards 21A, 21B from the closed front side to the open rear side of the cover unit 20 and communicate with the mounting recess 22. The body-clamping holes 23 are tapered from the closed front side to the open rear side of the cover unit 20, and each body-clamping hole 23 has a length and a width. The length of each one of the body-clamping holes 23 is longer than the length of a corresponding head-clamping hole 13 and the width of the body-clamping hole 23 is wider than the width of the corresponding head-clamping hole 13. Furthermore, the cover unit 20 has two pairs of wave-shaped edges 231 formed between the mounting boards 21A, 21B and the body-clamping holes 23 to enable the body-clamping holes 23 to clamp the bodies 51 of the ampoules 50 of various sizes. In addition, the widths of the body-clamping holes 23 are larger than the widths of the head-clamping holes 13. Then, when the opening unit 10 is mounted in the cover unit 20, the head-clamping holes 13 of the opening unit 10 are located within the ranges of the body-clamping holes 23 of the cover unit 20. Furthermore, when the opening unit 10 is mounted in the cover unit 20, the engaging element 113 engages the body-clamping hole 23 of the lower mounting board 21B to provide a positioning effect to the opening unit 10 and the cover unit 20.

The view window 24 is formed through one of the sidewalls of the cover unit 20 and communicates with the view window 14 of the opening unit 10 when the opening unit 10 is mounted in the cover unit 20. The via holes 25 are respectively formed through the mounting boards 21A, 21B, are formed proximal to the open rear side of the cover unit 20, and align with the inserting holes 15 of the opening unit 10 when the opening unit 10 is mounted in the cover unit 20. Preferably, the diameters of the via holes 25 are larger than the diameters of the inserting holes 15. The cover unit 20 further has multiple engaging protrusions 251 formed in the via holes 25 at intervals to engage a needle cap.

The through hole 26 is formed through the closed front side of the cover unit 20 proximal to the lower mounting board 21B. When the opening unit 10 is mounted in the cover unit 20, the driving tab 16 extends out of the closed front side of the cover unit 20 via the through hole 26. The positioning groove 27 is formed in the lower mounting board 21B, and when the opening unit 10 is mounted in the cover unit 20, the positioning groove 27 is disposed around the positioning blocks 17 of the open unit 10. In addition, the assemblement between the positioning groove 27 and the positioning blocks 17 can be used to prevent the opening unit 10 from misaligning from the cover unit 20. In use, the opening unit 10 can also be used individually without assembling with the cover unit 20.

Figure 2:
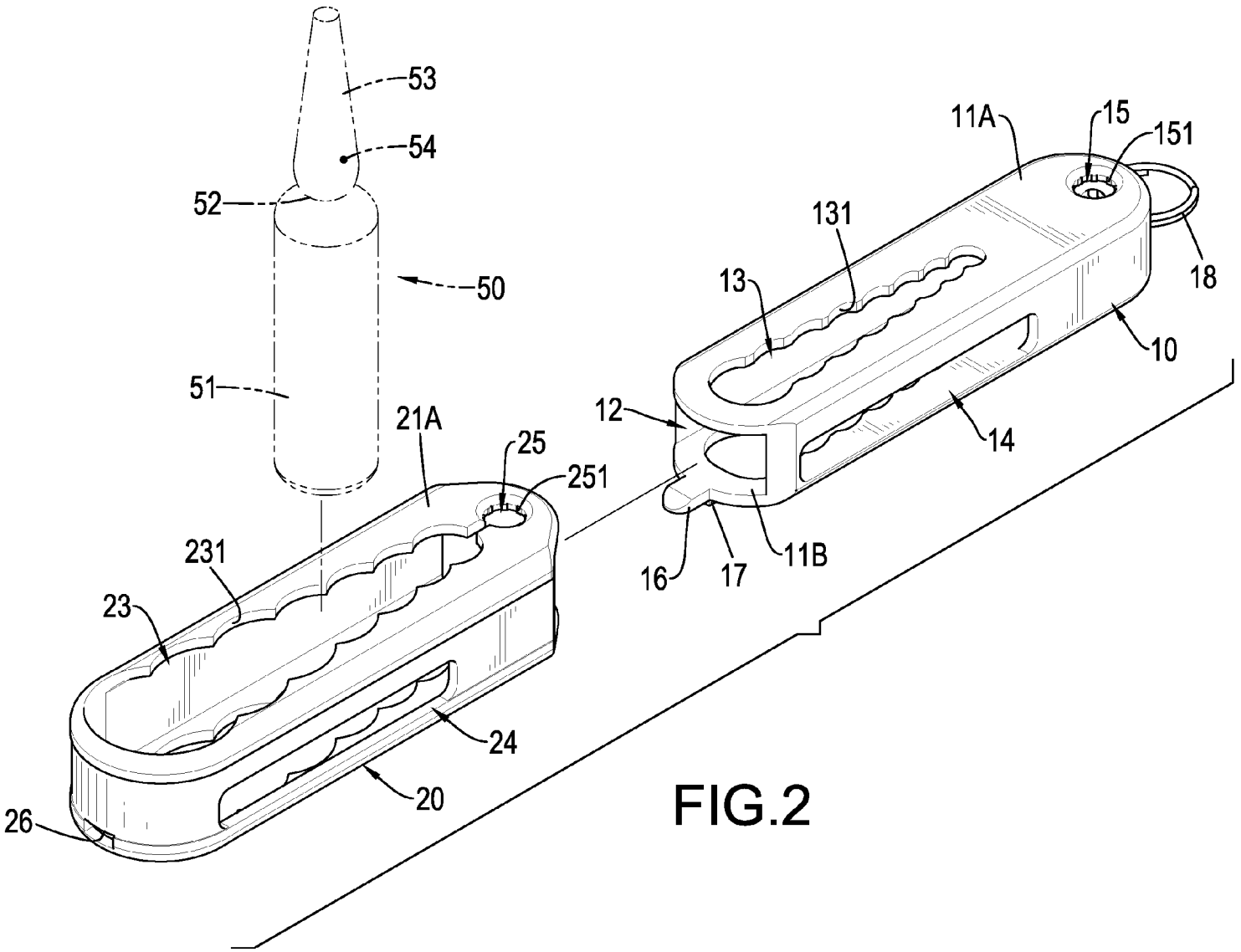
FIG. 2 is an exploded perspective view of the ampoule opener in FIG. 1, shown with an ampoule.
Figure 3:
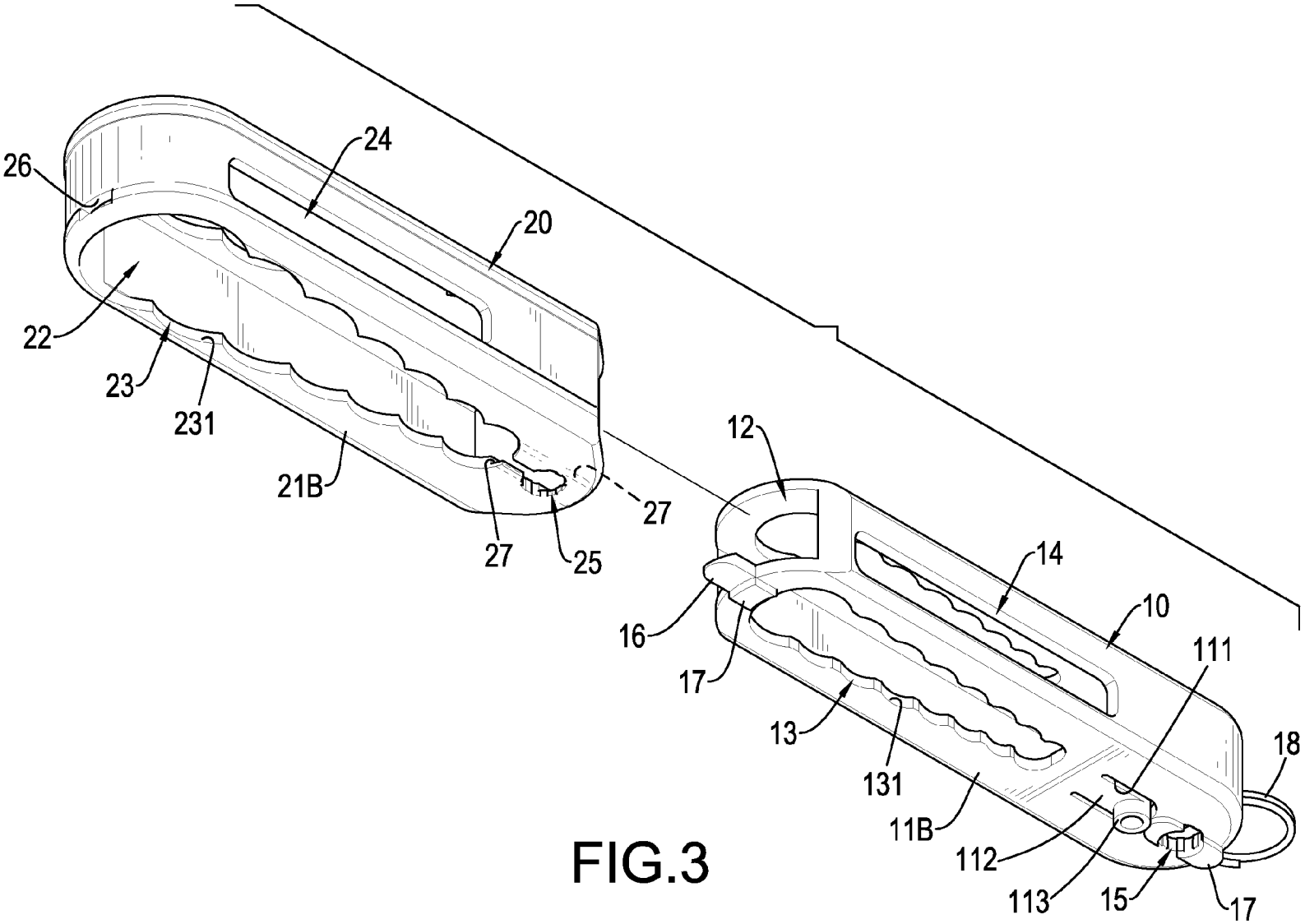
FIG. 3 is another exploded perspective view of the ampoule opener in FIG. 1.
Figure 5:
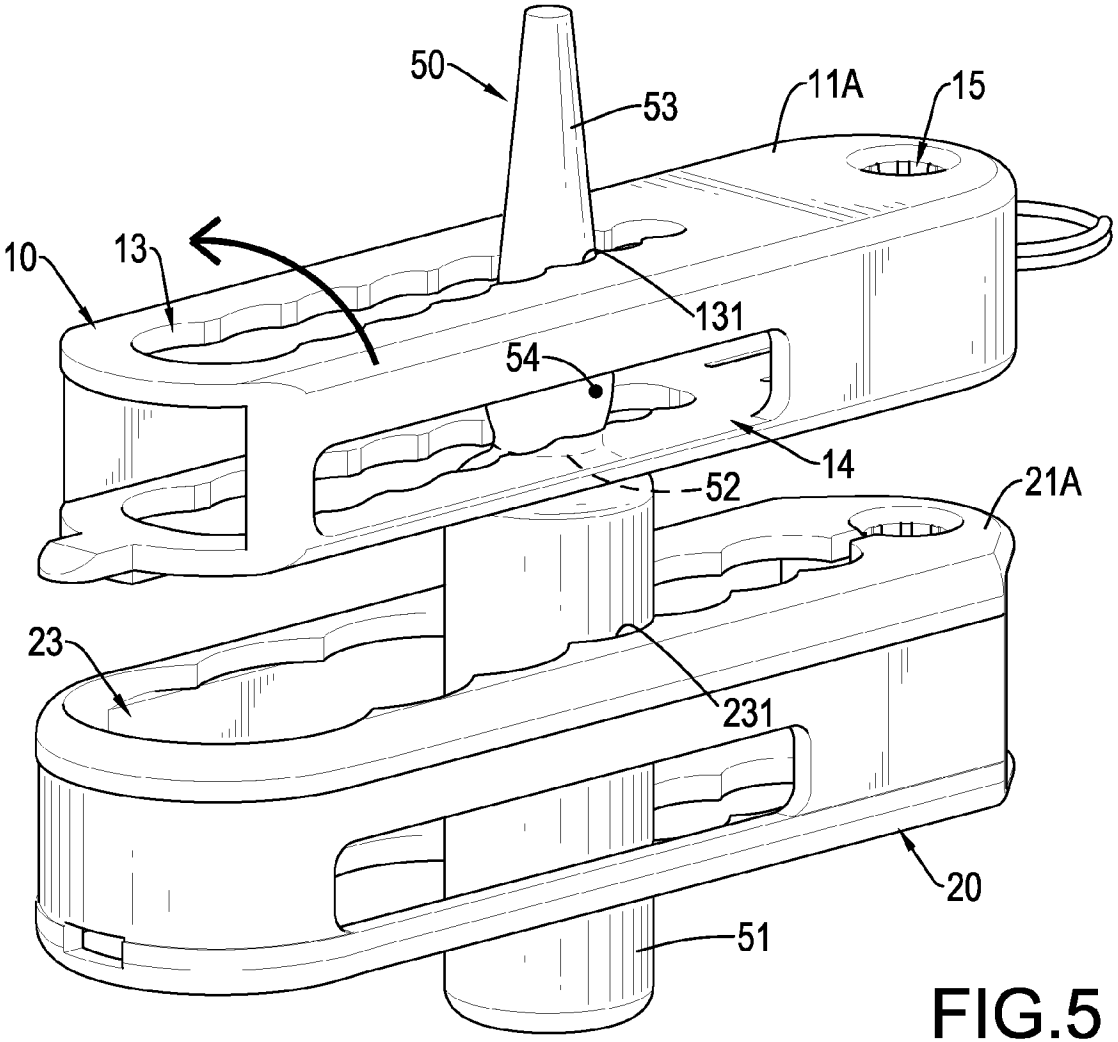
FIG. 5 is an operational perspective view of the ampoule opener in FIG. 1, shown with the ampoule.

With reference to FIGS. 2 and 5, when a user uses the ampoule opener in accordance with the present invention to open the ampoule 50, one hand of the user securely holds the cover unit 20, and the body 51 of the ampoule 50 is mounted in the cover unit 20 and engages the wave-shaped edges 231 of the cover unit 20 via the body-clamping holes 23. Then, the other hand of the user holds the opening unit 10 to mount the opening unit 10 around the head 53 and the neck 52 of the ampoule to enable the wave-shaped flanges 131 of the opening unit 10 to respectively engage the neck 52 and the head 53 of the ampoule 50 above the cover unit 20. The user can see the scoring mark 54 on the ampoule 50 via the view window 14 and can accordingly break the neck 52 of the ampoule 50 easily by lever principle between the head-clamping holes 13 of the panels 11A, 11B to open the ampoule 50.

The head-clamping holes 13 and the body-clamping holes 23 are elongated in length and tapered in width, and respectively have the wave-shaped flanges 131 and the wave-shaped edges 231, such that the ampoules 50 of various sizes can be mounted and clamped in the opening unit 10 and the cover unit 20. Then, the user can choose the wave-shaped flanges 131 and the wave-shaped edges 231 of the optimal size to engage the body 51, the neck 52 and the head 53 of the ampoule 50, and this can improve the convenience and practicality of the ampoule opener in use. Furthermore, when the neck 52 and the head 53 of the ampoule 50 are respectively mounted in the head-clamping holes 13 of the panels 11A, 11B, a gap between the head 53 and the head-clamping hole 13 of the upper panel 11A is larger than a gap between the neck 52 and the head-clamping hole 13 of the lower panel 11B and this can prevent the head 53 of the ampoule 50 from chipping by rigidity during the course of breaking, so as to improve the safety of using the ampoule opener in accordance with the present invention.

Figure 4:
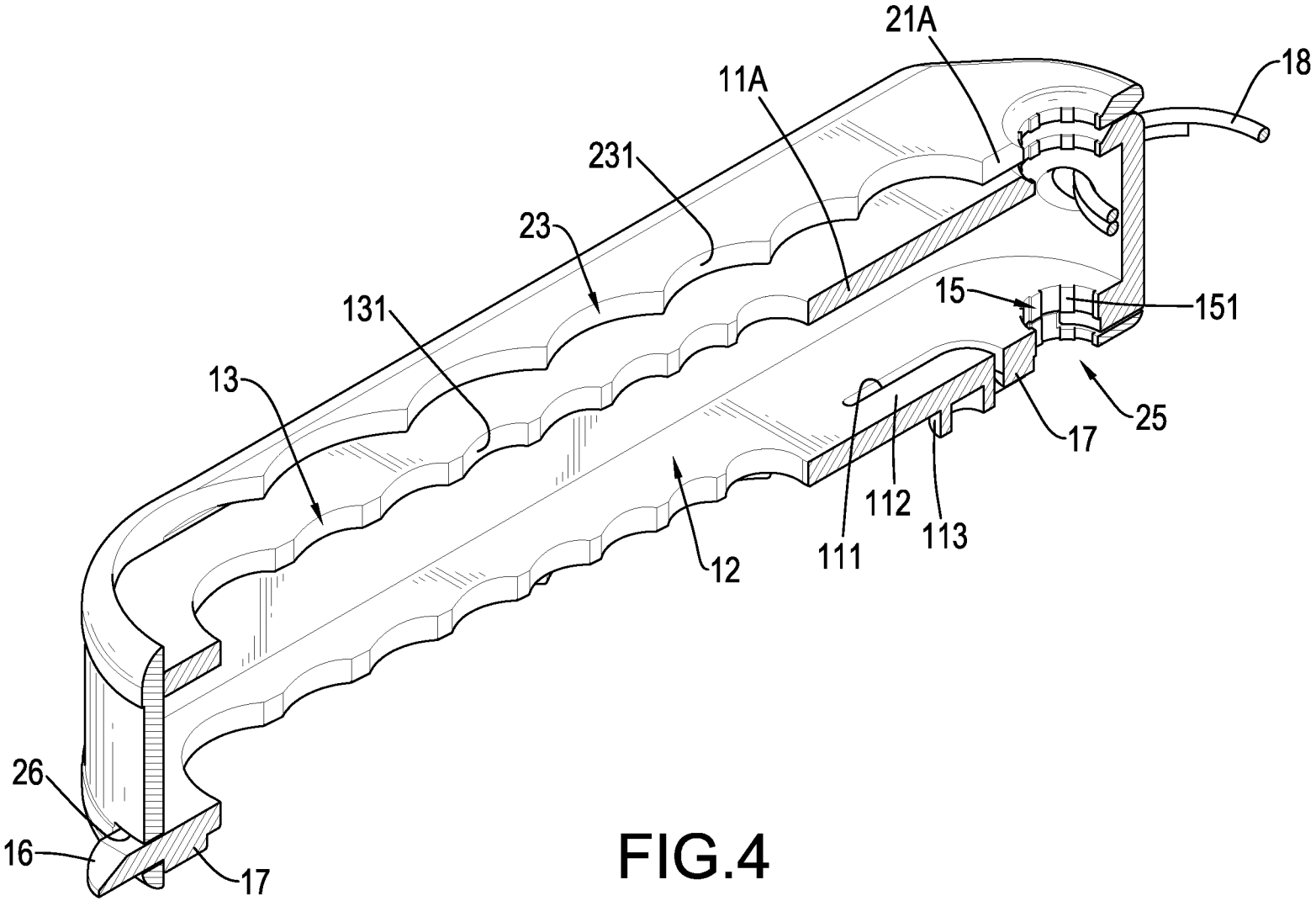
FIG. 4 is an enlarged perspective view in partial section of the ampoule opener in FIG. 1.
Figure 6:
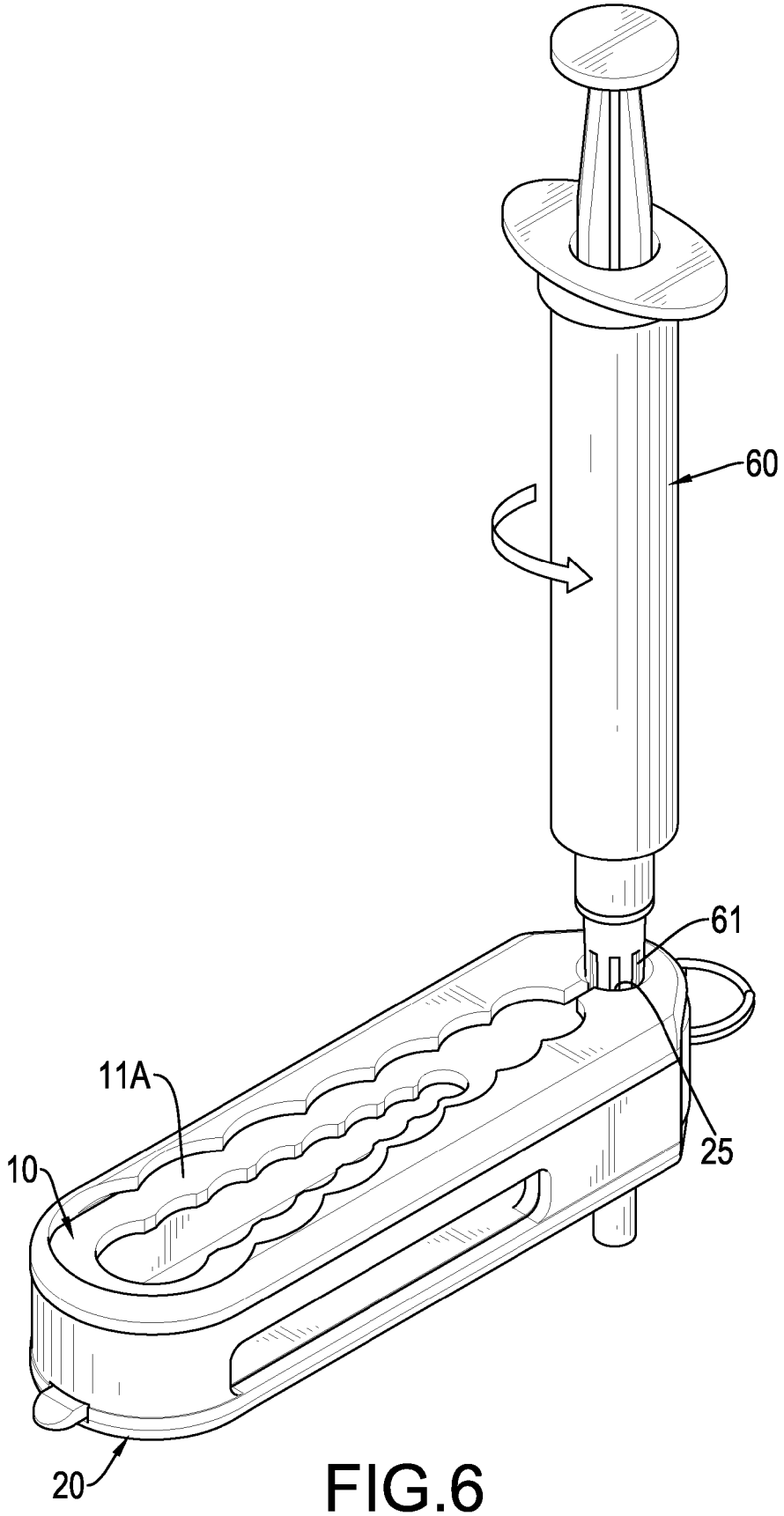
FIG. 6 is another operational perspective view of the ampoule opener in FIG. 1, shown used for recycling a needle from a syringe.
Figure 7:
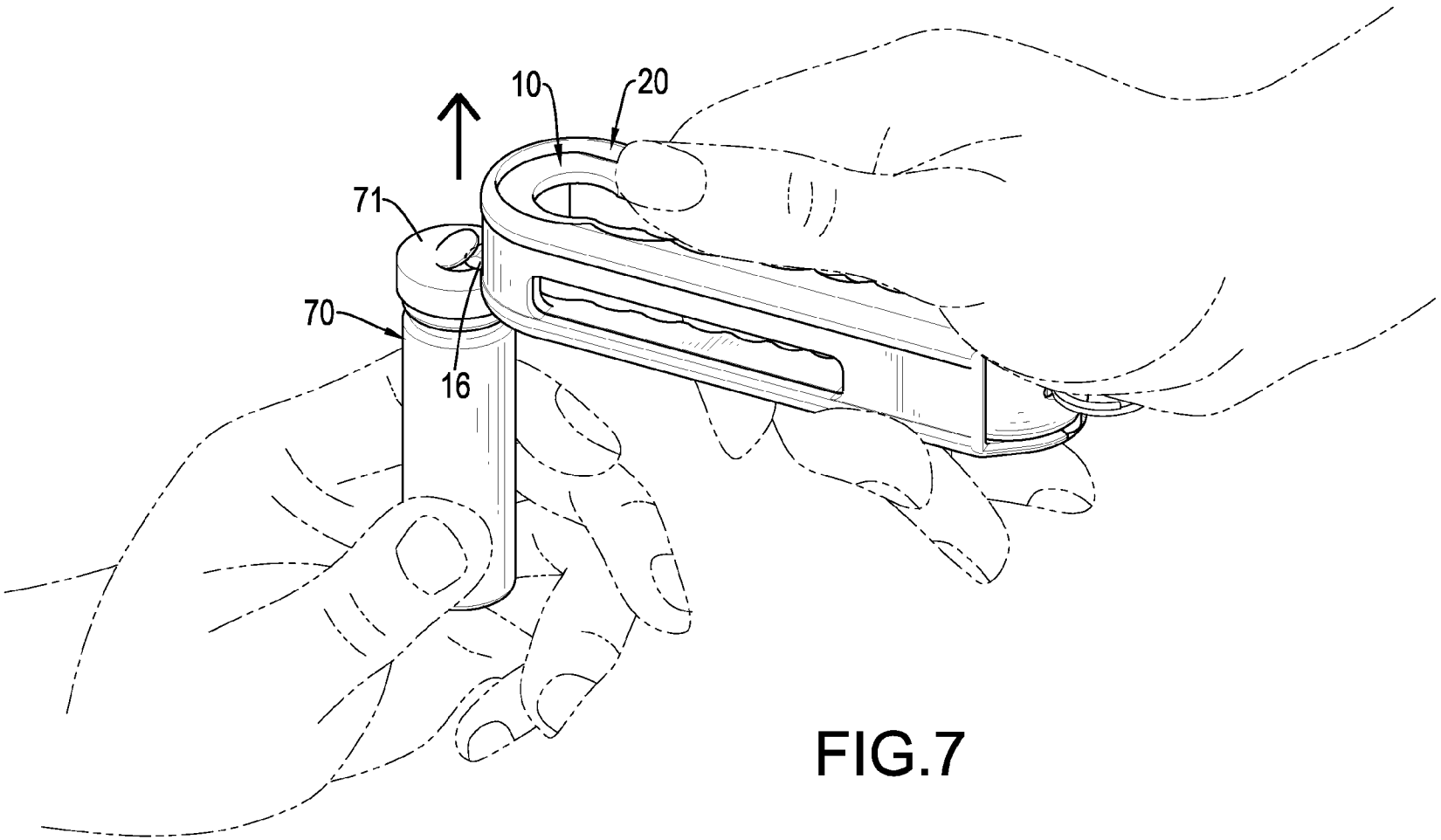
FIG. 7 is further another operational perspective view of the ampoule opener in FIG. 1, shown opening a medication vial with a driving tab of the ampoule opener.

With reference to FIGS. 4 and 6, the inserting holes 15 of the opening unit 10 and the via holes 25 of the cover unit 20 can be used for mounting and engaging a needle cap 61 of a syringe 60. By engaging the needle cap 61 with the engaging protrusions 151, 251, when the syringe 60 is rotated relative to the ampoule opener, the needle cap 61 with the needle can be separated from the syringe 60 safely for recycling. With further reference to FIG. 7, the driving tab 16 of the opening unit 10 can be used to remove a cover 71 from a medication vial 70. Then, the user can withdraw the medication from the vial 70.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ampoule opener having:

an opening unit being a rectangular rigid frame and having a closed rear side;

an open front side;

two sidewalls formed with the closed rear side of the opening unit;

two panels respectively being an upper panel and a lower panel, formed with the sidewalls and the closed side of the opening unit and facing each other;

two head-clamping holes being elongated, respectively formed through the panels and tapered from the open front side to the closed rear side of the opening unit, and each head-clamping hole having a width;

two pairs of wave-shaped flanges respectively formed between the panels and the head-clamping holes to enable the head-clamping holes to clamp an ampoule; and a view window formed through one of the sidewalls of the opening unit between the panels.

2. The ampoule opener as claimed in claim 1, wherein each panel has a mounting end and a holding end; and the opening unit has a driving tab formed on and protruding from the mounting end of the lower panel.

3. The ampoule opener as claimed in claim 2, wherein the opening unit has two inserting holes respectively formed through the panels proximal to the holding ends of the panels and aligning with each other;

multiple engaging protrusions formed in the inserting holes at intervals; and wherein the inserting hole that is formed through the upper panel has a diameter larger than a diameter of the inserting hole that is formed through the lower panel.

4. The ampoule opener as claimed in claim 1, wherein the opening unit has two inserting holes respectively formed through the panels proximal to the holding ends of the panels and aligning with each other;

multiple engaging protrusions formed in the inserting holes at intervals; and wherein the inserting hole that is formed through the upper panel has a diameter larger than a diameter of the inserting hole that is formed through the lower panel.

5. The ampoule opener as claimed in claim 1, wherein the ampoule opener has a cover unit being flexible, detachably mounted around the opening unit, and having:

two sidewalls;

an open rear side;

a closed front side formed with the sidewalls of the cover unit;

two covering boards respectively being an upper covering board and a lower covering board, and formed with the sidewalls and the closed front side of the cover unit;

a mounting recess formed in the cover unit between the sidewalls, the closed front side and the covering boards of the cover unit and communicating with the open rear side of the cover unit;

two body-clamping holes being elongated, being tapered from the closed front side to the open rear side of the cover unit, respectively formed through the mounting boards and communicating with the mounting recess, and each one of the body-clamping holes having a width wider than the widths of the head-clamping holes; and two pairs of wave-shaped edges formed between the mounting boards and the body-clamping holes to enable the body-clamping holes to clamp the ampoule.

6. The ampoule opener as claimed in claim 5, wherein the cover unit has a view window formed through one of the sidewalls of the cover unit and communicating with the view window of the opening unit when the opening unit is mounted in the cover unit.

7. The ampoule opener as claimed in claim 6, wherein each panel has a mounting end and a holding end;

the opening unit has a driving tab formed on and protruding from the mounting end of the lower panel;

the cover unit has a through hole formed through the closed front side of the cover unit proximal to the lower mounting board to enable the driving tab to extend out of the closed front side of the cover unit via the through hole when the opening unit is mounted in the cover unit.

8. The ampoule opener as claimed in claim 6, wherein the opening unit has two inserting holes respectively formed through the panels proximal to the holding ends of the panels and aligning with each other; and multiple engaging protrusions formed in the inserting holes at intervals; the cover unit has two via holes respectively formed through the mounting boards proximal to the open rear side of the cover unit and aligning with the inserting holes of the opening unit when the opening unit is mounted in the cover unit; and multiple engaging protrusions formed in the via holes at intervals.

9. The ampoule opener as claimed in claim 5, wherein each panel has a mounting end and a holding end;

the opening unit has a driving tab formed on and protruding from the mounting end of the lower panel;

the cover unit has a through hole formed through the closed front side of the cover unit proximal to the lower mounting board to enable the driving tab to extend out of the closed front side of the cover unit via the through hole when the opening unit is mounted in the cover unit.

10. The ampoule opener as claimed in claim 5, wherein the opening unit has two inserting holes respectively formed through the panels proximal to the holding ends of the panels and aligning with each other; and multiple engaging protrusions formed in the inserting holes at intervals; the cover unit has two via holes respectively formed through the mounting boards proximal to the open rear side of the cover unit and aligning with the inserting holes of the opening unit when the opening unit is mounted in the cover unit; and multiple engaging protrusions formed in the via holes at intervals.

* * * * *